US006363872B1

(12) United States Patent
Heckner

(10) Patent No.: US 6,363,872 B1
(45) Date of Patent: Apr. 2, 2002

(54) SEWING MACHINE WITH AN OVERLOAD CLUTCH

(75) Inventor: Christoph Heckner, Bielefeld (DE)

(73) Assignee: Dürkopp Adler Aktiengesellschaft (DE)

( * ) Notice: Subject to any disclaimer, the term of this patent is extended or adjusted under 35 U.S.C. 154(b) by 0 days.

(21) Appl. No.: 09/561,668

(22) Filed: May 1, 2000

(30) Foreign Application Priority Data

May 4, 1999 (DE) ..... 199 20 400

(51) Int. Cl.[7] ..... D05B 69/36
(52) U.S. Cl. ..... 112/277; 112/220
(58) Field of Search ..... 112/277, 275, 112/220, 470.01; 700/143; 192/30 R

(56) References Cited

U.S. PATENT DOCUMENTS 4,195,585 A * 4/1980 Takahashi et al. ..... 112/277
5,178,083 A * 1/1993 Duret et al. ..... 112/277
5,752,455 A * 5/1998 Papajewski et al. .... 112/220 X

OTHER PUBLICATIONS

Adler 167–3S;–FA3S, TL.402 167—24.2 Nov. 1979.

* cited by examiner

*Primary Examiner*—Peter Nerbun
(74) *Attorney, Agent, or Firm*—Ostrolenk, Faber, Gerb & Soffen, LLP

(57) ABSTRACT

A sewing machine (1) with an overload clutch in the form of a friction clutch in the region of the handwheel (44), with a positioning motor (57), including a motor part (56) and a control part (55), and with a position transmitter (51) connected to the arm shaft (5). In the event of a blockage of the arm shaft (5), the control part (56) causes the positioning motor (57) to stop immediately and a fault warning to be output on an indicator panel (68) of the control apparatus (66). After the fault has been eliminated and the power supply has subsequently switched off and switched on again, the sewing machine (1) is ready for operation again.

18 Claims, 1 Drawing Sheet

SEWING MACHINE WITH AN OVERLOAD CLUTCH

BACKGROUND OF THE INVENTION

1. Field of the Invention

The invention relates to a sewing machine with an overload clutch for breaking the drive connection when a blockage occurs.

2. Related Art

A known sewing machine with an overload clutch is the ADLER Model 167-FA3S, which is described in the replacement parts diagram designated "Adler 167-3S; -FA3S, TL. 402 167-24.2-Nov. 1979." In this sewing machine, the overload clutch, capable of being engaged in a predetermined position, is provided between the handwheel, designed as a driving wheel, and the arm shaft which functions as the drive shaft of the sewing machine.

One disadvantage of this sewing machine is that, if there is a blockage and the overload clutch is disengaged as a result, impact loads, that is to say a moment of momentum, are continuously exerted on the blocked sewing machine in the course of each revolution of the driving part while the sewing machine drive is in the run-down phase. This results in a considerable load on the components involved. Moreover, the duration of this load depends on how quickly the operator of the sewing machine notices the blockage and causes the sewing machine to stop by actuating the pedal appropriately.

Further, the assembly and adjustment of the known sewing machine take a considerable amount of time, especially the adjustment of the setscrews (part no. 992 01 231 0 in the above-mentioned replacement parts diagram) which set the springs (067 35 008 0) so that the springs apply a relatively uniform prestressing force of a desired magnitude to the positioning balls (996 06 025 0) in the overload clutch.

SUMMARY OF THE INVENTION

The invention provides an improved sewing machine with an overload clutch, wherein it becomes easier for the operator to work on the sewing machine, the behavior of the operator no longer has any influence in the event of a fault, and the load on the sewing machine when a blockage occurs is reduced.

This object may be achieved, according to one aspect of the invention, by a sewing machine with the following features:

- a drive shaft with a driving wheel,
- a drive motor with an electronic control, the drive motor being drivingly connected to the driving wheel,
- a position transmitter transmits signals to the control representing the rotary position of the drive shaft, the position transmitter being connected to the drive shaft for being driven thereby, and
- the position transmitter's signals to the control indicate when a blockage on the sewing machine occurs, whereupon the control causes the drive motor to stop.

Advantageously, the overload clutch is a friction clutch and is arranged between the driving wheel and the drive shaft.

What is achieved according to this aspect of the invention is that, when the overload clutch takes effect, impact loads on the sewing machine are basically eliminated, and the drive motor is stopped automatically if a blockage occurs, irrespective of the operator's behavior. With the sewing machine according to the invention, handling becomes easier, wear on components of the sewing machine is reduced and a reliably working solution which can be produced at lower cost is provided.

An advantageous development is proposed by the feature wherein the driving wheel is designed with a handwheel.

The feature wherein the overload friction clutch has a single pair of frictional surfaces, the pressure force of which is applied by a prestressed spring, leads to a very simple and cost-effective solution. The value of the transmittable torque can easily be set, since the prestress of the spring can be set by means of a nut. This makes it possible to adapt to the respective type of sewing machine and its load and to limit the load which is applied to the machine parts of the sewing machine in the event of faults.

Other features and advantages of the present invention will become apparent from the following description of an embodiment of the invention which refers to the accompanying drawings.

BRIEF DESCRIPTION OF THE DRAWINGS

An exemplary embodiment of the invention is explained in more detail below with reference to the drawings in which.

DETAILED DESCRIPTION OF AN EMBODIMENT OF THE INVENTION

Figure 1:
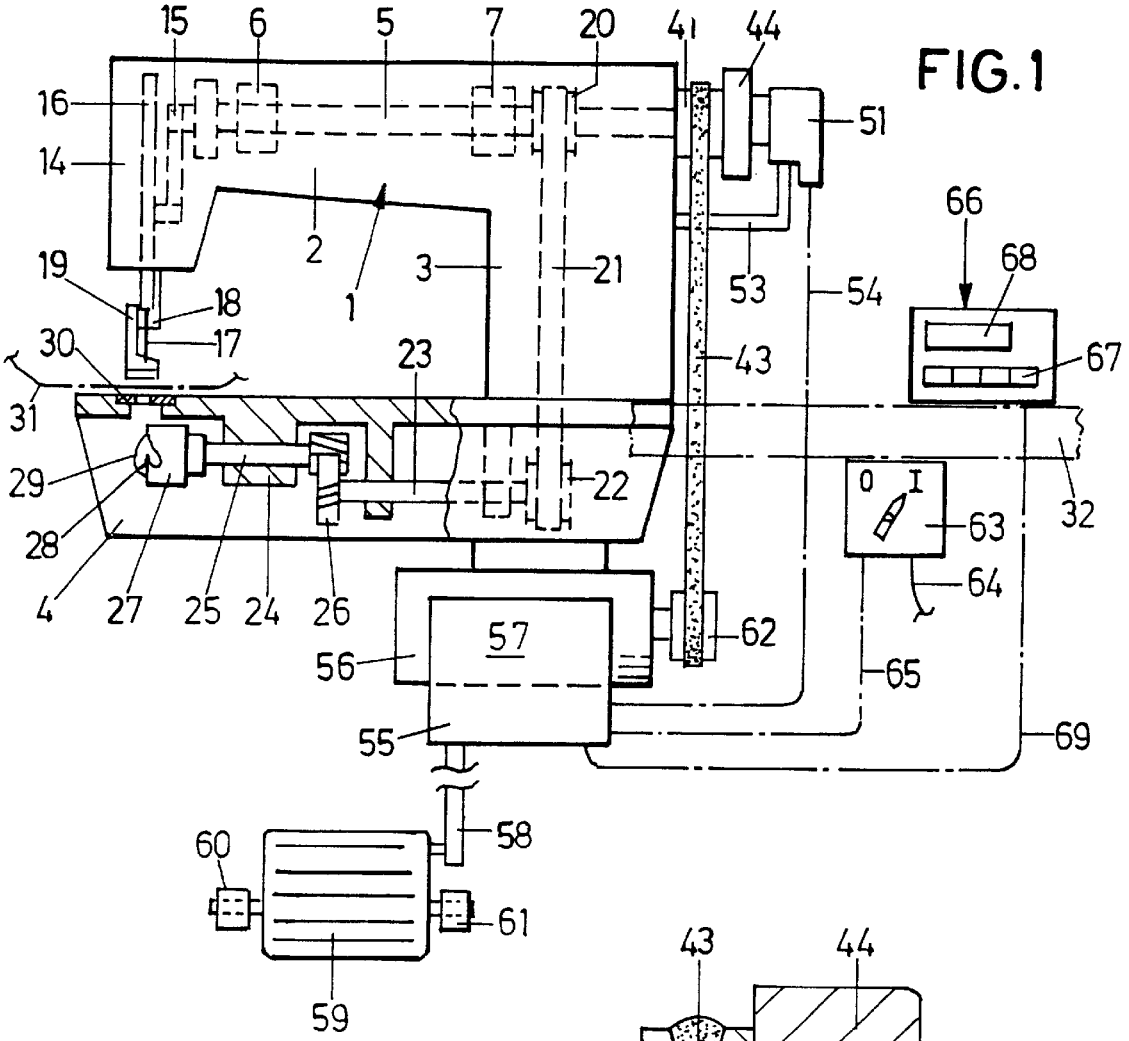
FIG. 1 shows a front view of a sewing machine.

A sewing machine 1 is designed with an upper arm 2, a vertical column 3 and a baseplate 4. Mounted rotatably in bearings 6, 7 in the arm 2 is an arm shaft 5, of which the end projecting from the arm 2 is received in a bore 8 of a hub 9. The hub 9 is designed with a setscrew 10, by means of which the hub 9 is fastened to the arm shaft 5. The hub 9 is designed with an extension 11, on which a ball bearing 12 is press-fitted. The ball bearing 12 is received in a bearing 13 formed in the arm 2.

The free end of the arm 2 forms a head 14, in which the arm shaft 5 is connected to a crank mechanism 15. The crank mechanism 15 is provided for the up-and-down drive of a needle bar 16 mounted displaceably in the head 14. The needle bar 16 is provided at its lower end with a sewing needle 17 which guides a needle thread (not illustrated). Furthermore, a cloth press bar 18 is mounted displaceably in the head 14 and is equipped at its lower end with a press foot 19.

Fastened to the arm shaft 5 is a toothed-belt wheel 20, around which is looped an endless toothed belt 21. The toothed belt 21 extends downwards through the hollow column 3 and there loops around a toothed-belt wheel 22 which is dimensioned according to the toothed-belt wheel 20 and which is arranged fixedly on a shaft 23 mounted rotatably in bearings (not designated) in the baseplate 4. Furthermore, a shaft 25 is mounted rotatably in a bearing 24 in the baseplate 4. The shafts 23, 25 are drive-connected by means of a gearwheel mechanism 26, the latter having a transmission ratio of i=1:2. When the shaft 23 or the arm shaft 5 rotates once, the shaft 25 rotates twice.

A looper 27 containing a thread stock is fastened to that end of the shaft 25 which faces away from the gearwheel mechanism 26. The looper 27 is arranged on the shaft 25 in such a way that a looper tip 28 runs, free of play, past the sewing needle 17 when the latter is near its lower position, for taking up a thread loop formed by the needle thread when a double-thread lock stitch is executed. The looper 27 is designed, furthermore, with a thread guide plate 29 which extends away from the gearwheel mechanism 26 in the direction of the shaft 25.

A needle plate 30 is firmly screwed to the baseplate 4 above the looper 27 and has a stitch hole (not designated) for the unimpeded passage of the sewing needle 17. Furthermore, the sewing machine 1 is equipped with a cloth feed device (not illustrated), which imparts an advancing movement to the piece of sewing material 31 held down on the needle plate 30 by the press foot 19, while the sewing needle 17 is located outside said piece of sewing material. According to FIG. 1, the baseplate 4 is mounted in a stepped cutout in a tabletop 32.

Figure 2:
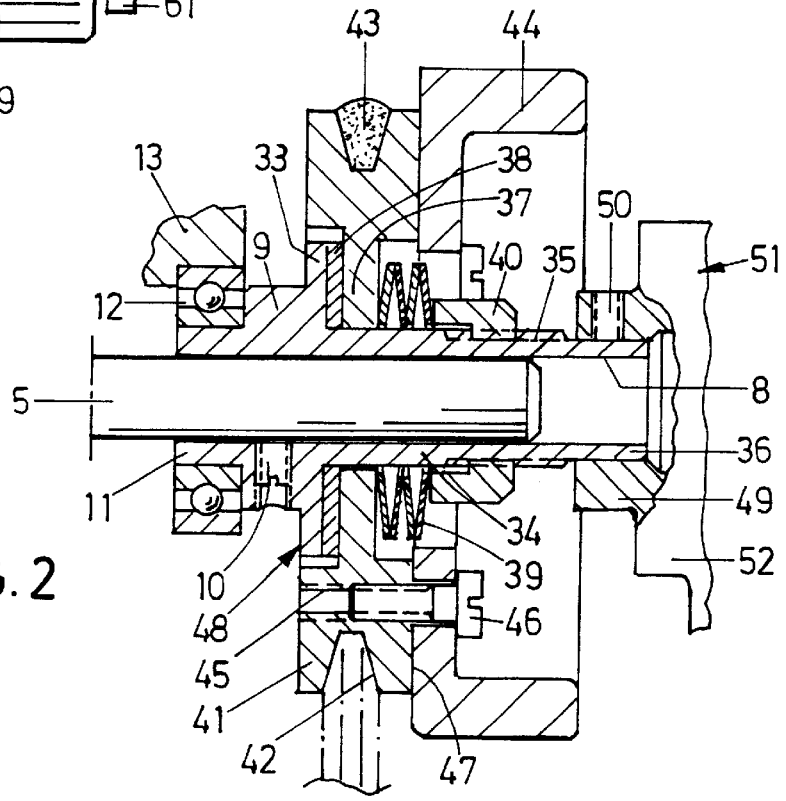
FIG. 2 shows part of the sewing machine shown in FIG. 1, in an enlarged view shown in half section.

As may be gathered from FIG. 2, the hub 9 is designed with a larger extension 33 and with a tapered extension 34 adjoining the latter. Furthermore, the extension 34 is designed with a thread 35 and with an end 36 which tapers even further. A bearing piece 37 is received, free of play, but rotatably, on the extension 34. A disk 38, which is produced as a friction lining from a material customary for clutch disks, is adhesively bonded to the bearing piece 37 on its end face facing the extension 33. The disk 38 has a diameter corresponding to the outside diameter of the extension 33.

A spring 39 forming a spring assembly bears against the free end face of the bearing piece 37, said spring being composed overall of four cup springs arranged in alternating directions. Screwed on the thread 35 is a nut 40 which bears against the free side of the spring 39. The spring 39 is in a prestressed state, so that the bearing piece 37 is pressed with the disk 38 against the extension 33.

The bearing piece 37 is designed with an outer ring 41 as a driving wheel which is designed with a wedge-shaped indentation 42 for receiving a V-belt 43. The ring 41 is designed with three threaded bores extending parallel to the bore 8. Screws are received in the threaded bores, the screws passing through corresponding passage bores of a handwheel 44. A threaded bore 45 and a screw 46 are shown as examples of the threaded bores and of the screws screwed in them. The design of the threaded bores and of the screws received in them results in a flanged connection 47, so that the bearing piece 37 and the handwheel 44 are firmly connected to one another.

The bearing piece 37, together with the disk 38 located on it, the extension 33 and the prestressed spring 39 form components of an overload clutch 48, which in this embodiment is a friction clutch, which makes it possible to transmit a set torque from the bearing piece 37 to the hub 9 by friction on a single pair of frictional surfaces (contact surfaces of the disk 38 with the end face of the extension 33). Conversely, the overload clutch 48 slips when the torque to be transmitted exceeds the preset value.

A tubular part 49 provided with a setscrew 50 is received on the end 36. The end 36 and the part 49 are connected firmly to one another by means of the setscrew 50. The part 49 is a component of a pulse transmitter which serves as a position transmitter 51. The position transmitter 51 has, inside a fixed housing 52, a mounting for the part 49, with disks attached to it and having markings, in order, by means of sensors mounted on the housing 52, to receive pulses which represent the rotary position and the rotational speed of the arm shaft 5. The housing 52 is secured against rotation via a holder 53 fastened to the column 3.

The position transmitter 51 is connected via an electric line 54 to an electronic control part 55 which is part of a drive motor which has a motor part 56 and which is designated below as a positioning motor 57. The positioning motor 57 is known from the prior art and is commercially available, for example, as EFKA type DC1600/DA82GA. The positioning motor 57 is designed in such a way that it is possible to stop the sewing machine 1 in specific rotary positions of the arm shaft 5, for example in a rotary position in which the sewing needle 17 is in its upper or lower position.

The positioning motor 57 is fastened, below the baseplate 4 of the sewing machine 1, to a stand (not illustrated) carrying the tabletop 32.

The control part 55 has a pull-and-push rod (not designated) which is connected mechanically to a pedal 59 via a connecting rod 58. The pedal 59 is mounted pivotably in fixed bearings 60, 61 on the stand. The motor part 56 is provided with a V-belt pulley 62 which is located on a shaft and on which the free end of the V-belt 43 is received.

A switchbox 63, in which a power supply line 64 terminates, is fastened below the tabletop 32. The switchbox 63 is connected electrically to the control part 55 via a line 65. The switchbox 63 is designed with a switching lever, by means of which the electric connection of the line 64 to the line 65 can be made (position 1) or broken (position 0).

Fastened to the tabletop 32 is a box-shaped control apparatus 66, designated as a control panel, which has an input switch or switches 67 and an indicator panel 68 for indicating alphanumeric information. The control apparatus 66 is connected electrically to the control part 55 via a line 69.

Operation is as follows:

Starting from an operationally ready state of the sewing machine 1, with the switching lever on the switchbox 63 being in the position I illustrated, the motor part 56 sets the arm shaft 5 in rotation after the pedal has been depressed with the tip of the foot. At the same time, the necessary torque is transmitted from the V-belt 43 to the ring 41 and consequently via the pair of frictional surfaces, that is to say via the surfaces of the disk 38 which are in contact with one another and via the end face of the extension 33, to the arm shaft 5 as a result of frictional connection, whereby a seam is produced in the piece of sewing material 31. During this action, the control part 55, after comparing the desired rotational speed predetermined by the pedal 59 and the actual rotational speed represented by signals from the position transmitter 51, regulates the rotational speed of the arm shaft 5. Regulation by means of the control part 55 is carried out such that, even when an additional load on the sewing machine 1 occurs, for example due to sewing over a cross seam, the rotational speed is kept virtually constant, with the exception of a slight acceptable control deviation.

If there is a blockage of the sewing machine 1, for example because the needle thread guided by the needle has been knocked into the looper 27 or a broken-off sewing needle 17 has collided with the threaded guide plate 29, the arm shaft 5 comes to a standstill in a fraction of a second. The transmission of pulses from the position transmitter 51 to the control path 55 is thereby interrupted. The control part 55 reacts to this state of control deviation initially by transmitting a torque which is higher than the normal torque. That is to say, the arm shaft 5 together with the hub 9 is at a standstill, while the bearing piece 37 together with the ring 41 continues to rotate. This state persists for a short time, for example for 20 milliseconds. Then, the control part 55 switches off the torque and subsequently outputs alphanumeric information as a fault warning to the indicator panel 68.

The sequence described up to now takes place, irrespective of the position in which the operator has positioned the pedal when the blockage of the sewing machine 1 has occurred. Consequently, an incorrect action or behavior of the operator of the sewing machine 1 has no influence on the sequence described.

In the positioning motor 57, the control part 55 acknowledges the occurrence of a fault, for example a cable break or incorrect behavior of the position transmitter 51, by outputting an unequivocal alphanumeric fault warning on the indicator panel 68 of the control apparatus 66. The positioning motor 57 exhibits the same behavior in the absence of the transmitted pulses. The positioning motor 57 can thereupon be put into operation again, only after the power supply has been switched off and switched on again, by an appropriate actuation of the switching lever on the switch box 63.

After the fault caused by the blockage of the arm shaft 5 has been eliminated and the power supply has been switched off and switched on again, the sewing machine 1 can be put into operation again.

Although the present invention has been described in relation to a particular embodiment thereof, many other variations and modifications and other uses within the spirit and scope of the invention will become apparent to those skilled in the art. Therefore, the present invention is not limited by the specific disclosure herein.

What is claimed is:

1. A sewing machine with an overload clutch for breaking the drive connection when a blockage of the sewing machine occurs, comprising:

a drive shaft with a driving wheel mounted thereon, a drive motor with an electronic control, the drive motor being connected to the driving wheel for driving the drive shaft, a position transmitter connected to the drive shaft, wherein the position transmitter transmits signals to the control representing the rotary position and speed of the drive shaft, an overload clutch comprising a friction clutch having a pair of friction surfaces arranged between the driving wheel and the drive shaft, wherein the signals transmitted by the position transmitter to the control indicate when the drive shaft is stopped by a blockage of the sewing machine, and wherein the control causes the drive motor to stop in response to the signals indicating that the drive shaft is stopped.

2. The sewing machine as claimed in claim 1, further comprising a handwheel attached to the driving wheel.

3. The sewing machine as claimed in claim 2, wherein a pressure force between said friction surfaces is applied by a prestressed spring.

4. The sewing machine as claimed in claim 3, wherein the friction clutch further comprises a nut arranged for setting the prestress of the spring.

5. The sewing machine as claimed in claim 1, wherein the friction clutch has a pair of frictional surfaces, and a pressure force between said surfaces is applied by a prestressed spring.

6. The sewing machine as claimed in claim 5, wherein the friction clutch further comprises a nut arranged for setting the prestress of the spring.

7. The sewing machine as claimed in claim 1, wherein the signals from the position transmitter cease when the drive shaft is stopped.

8. The sewing machine as claimed in claim 7, wherein the signals from the position transmitter are pulses.

9. A sewing machine with an overload clutch for breaking the drive connection when a blockage of the sewing machine occurs, comprising:

a drive shaft, a drive motor with an electronic control, the drive motor being connected for driving the drive shaft, a position transmitter connected to the drive shaft, wherein the position transmitter transmits signals to the control representing the rotary position and speed of the drive shaft, an overload clutch arranged for allowing the drive shaft to stop when a blockage occurs, said overload clutch having a pair of friction surfaces arranged between the driving wheel and the drive shaft, wherein the signals transmitted by the position transmitter to the control indicate when the drive shaft is stopped by a blockage of the sewing machine, and wherein the control causes the drive motor to stop in response to the signals indicating that the drive shaft is stopped.

10. The sewing machine as claimed in claim 9, wherein the signals from the position transmitter cease when the drive shaft is stopped.

11. The sewing machine as claimed in claim 10, wherein the signals from the position transmitter are pulses.

12. A sewing machine with an overload clutch for breaking the drive connection when a blockage of the sewing machine occurs, comprising:

a drive shaft with a driving wheel mounted thereon, a drive motor connected to the driving wheel for driving the drive shaft, and an overload clutch comprising a friction clutch having a pair of friction surfaces arranged between the driving wheel and the drive shaft.

13. The sewing machine as claimed in claim 12, further comprising a handwheel attached to the driving wheel.

14. The sewing machine as claimed in claim 13, wherein a pressure force between said friction surfaces is applied by a prestressed spring.

15. The sewing machine as claimed in claim 14, wherein the friction clutch further comprises a nut arranged for setting the prestress of the spring.

16. The sewing machine as claimed in claim 1, wherein said overload clutch slips automatically when the torque to be transmitted between the driving wheel and the drive shaft exceeds a predetermined value.

17. The sewing machine as claimed in claim 9, wherein said overload clutch slips automatically when the torque to be transmitted between the driving wheel and the drive shaft exceeds a predetermined value.

18. The sewing machine as claimed in claim 12, wherein said overload clutch slips automatically when the torque to be transmitted between the driving wheel and the drive shaft exceeds a predetermined value.

* * * * *